United States Patent [19]

Kubota et al.

[11] 4,398,517

[45] Aug. 16, 1983

[54] AIR-FUEL RATIO CONTROL SYSTEM

[75] Inventors: Masaharu Kubota, Musashino; Toshiro Kurihara, Koganei, both of Japan

[73] Assignees: Fuji Jukogyo Kabushiki Kaisha, Tokyo; Nissan Motor Co., Ltd., Yokohama, both of Japan

[21] Appl. No.: 280,969

[22] Filed: Jul. 7, 1981

[30] Foreign Application Priority Data

Jul. 16, 1980 [JP] Japan ..... 55-97361

[51] Int. Cl.[3] ..... F02M 17/00

[52] U.S. Cl. ..... 123/440

[58] Field of Search ..... 123/440, 489, 492

[56] References Cited

U.S. PATENT DOCUMENTS 4,096,834 6/1978 Norimatsu et al. ..... 123/489

4,103,649 8/1978 Matumoto et al. ..... 123/489 X 4,121,554 10/1978 Sueishi et al. ..... 123/440

*Primary Examiner*—Tony M. Argenbright

*Attorney, Agent, or Firm*—Martin A. Farber

[57] ABSTRACT

An air-fuel ratio control system for an internal combustion engine having an emission control system with a three-way catalytic converter for controlling the air-fuel ratio in accordance with the temperature of the engine and acceleration of the engine. A temperature sensor for detecting the engine temperature and an acceleration sensor for detecting the negative pressure in the intake passage corresponding to the acceleration of the engine are provided. An electronic control circuit is provided for controlling the air-fuel ratio to the stoichiometric air-fuel ratio in a normal operating condition and for stopping the control operation when the acceleration in the cold engine is detected by the temperature sensor and acceleration sensor.

3 Claims, 6 Drawing Figures

AIR-FUEL RATIO CONTROL SYSTEM

BACKGROUND OF THE INVENTION

The present invention relates to an air-fuel ratio control system for an internal combustion engine having an emission control system with a three-way catalytic converter for controlling air-fuel ratio correcting means in accordance with conditions of engine operation by detecting cooling water temperature and load on the engine.

Conventionally, this type of air-fuel ratio control system achieves a feedback control by detecting the air-fuel ratio from oxygen concentration in exhaust gases by an $O_2$ sensor. The detected air-fuel ratio is determined by a comparison circuit as to whether it is lean or rich comparing with the stoichiometric air-fuel ratio to produce an output signal. The output signal is sent to an electro-magnetic valve through a driver to actuate the valve for supplying a certain amount of air to a carburetor, and controlling the air-fuel ratio of the air-fuel mixture to the stoichiometric air-fuel ratio. The air-fuel ratio control system of such construction functions in good condition when the engine operates at a proper engine temperature. However, under cold engine operating condition, it is difficult to control the air-fuel ratio in accordance with the engine operation. Therefore, in an engine having an automatic choke device, the air-fuel ratio control system is so arranged that the system is rendered inoperative in the cold engine, while the air-fuel ratio of the mixture is controlled by the operation of the automatic choke device. However, the automatic choke device tends to open the choke valve before a proper time or to open it wider than a degree proper to the warming-up of the engine. Due to such difficulties, in the conventional air-fuel ratio control systems, the air-fuel ratio is always controlled to the stoichiometric air-fuel ratio even when the engine is in cold operating condition. Therefore, although during the cold engine operating condition at a constant speed with a light load, it produces an output torque sufficient to give a steady driveability, during half-open throttle or wide-open throttle operation, stumble operation of the engine occurs so that the output of the engine decreases.

This is because, despite the condition that the engine requires a rich air-fuel ratio during cold engine, mixture of air-fuel ratio leaner than that of the engine requirement is supplied to the engine by the air-fuel ratio control system, and further the air-fuel ratio is shifted to lean side when the automatic choke valve is forced opn by the drag of the air which is sucked in during acceleration.

SUMMARY OF THE INVENTION

Accordingly, it is an object of the present invention to provide an air-fuel ratio control system having means for selectively stopping the air-fuel ratio correcting operation when a temperature sensor for engine cooling water temperature detects a cold engine operation and a negative pressure sensor for the pressure in the intake passage of the engine detects heavy load condition of the engine.

According to the present invention, there is provided an air-fuel ratio control system for an internal combustion engine having an intake passage, a carburetor, an electro-magnetic valve for correcting the air-fuel ratio of the air-fuel mixture, an $O_2$-sensor for detecting the oxygen concentration of exhaust gases, a temperature sensor for detecting the engine temperature, an acceleration sensor corresponding to the negative pressure in said intake passage of the engine, and a closed loop control circuit responsive to outputs of the said all of sensors for producing a control output signal for driving said electro-magnetic valve for correcting the air-fuel ratio, in which the improvement comprises a switching circuit provided in said control circuit for rendering said control circuit unresponsive to the output of said $O_2$-sensor, and gate means responsive to outputs of said temperature sensor and acceleration sensor for actuating said switching circuit comprising an AND gate connected to said temperature sensor and acceleration sensor, said gate means being so arranged to actuate said switching circuit in such a manner that air-fuel ratio correction control with the closed loop control circuit is carried out when engine temperature is higher than a predetermined temperature and stopped when engine temperature is lower than said predetermined temperature and said acceleration detecting sensor is operated thereby making the air-fuel ratio rich.

The present invention will be fully described with reference to the accompanying drawings.

DETAILED DESCRIPTION OF THE PREFERRED EMBODIMENTS

Figure 1:
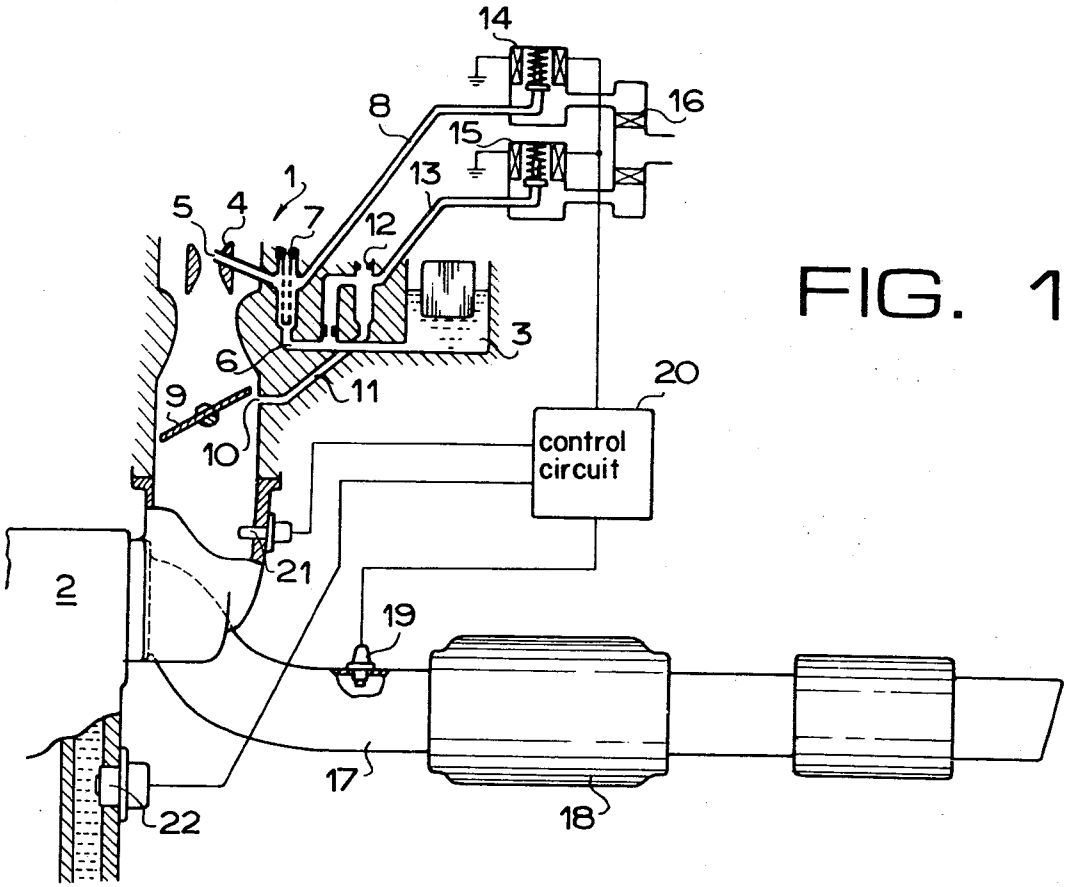
FIG. 1 shows construction of air-fuel ratio control system in accordance with the present invention.

Referring to FIG. 1, a carburetor 1 is connected to and upstream of an engine 2, and an air correction passage 8 communicates with an air bleed 7 which is located in a main fuel passage 6 communicating a float chamber 3 with a nozzle 5 of a venturi 4. Another air correction passage 13 communicates with another air bleed 12 which is located in a slow fuel passage 11 leading to a slow port 10 which diverges from the main fuel passage 6 and opens near a throttle valve 9. These air correction passages 8 and 13 are respectively provided with on-off type electromagnetic valves 14, 15, intake sides of which communicate with the atmosphere through an air cleaner 16. A three-way catalytic converter 18 for exhaust gas purification is provided in an exhaust pipe 17, and an $O_2$-sensor 19 is disposed upstream of the three-way catalytic converter 18 to detect the oxygen concentration in the exhaust gases representing the air-fuel ratio of the mixture. Further, a negative pressure sensor 21 is provided in the intake passage of the carburetor 1 and a cooling water temperature sensor 22 is provided on a cooling water jacket. Outputs from the $O_2$-sensor 19, negative pressure sensor 21 and water temperature sensor 22 are transmitted to a control circuit 20, a control output from which is in turn transmitted to the electro-magnetic valves 14, 15.

In such a construction, receiving a signal from the $O_2$-sensor 19, the control circuit 20 applies its output pulses to the on-off type electro-magnetic valves 14, 15, so that the valves are actuated at a duty ratio of applied pulses. Thus, the amount of air supplied to the carburetor is controlled thereby adjusting the air-fuel ratio of the mixture of the rich or lean side.

Figure 2:
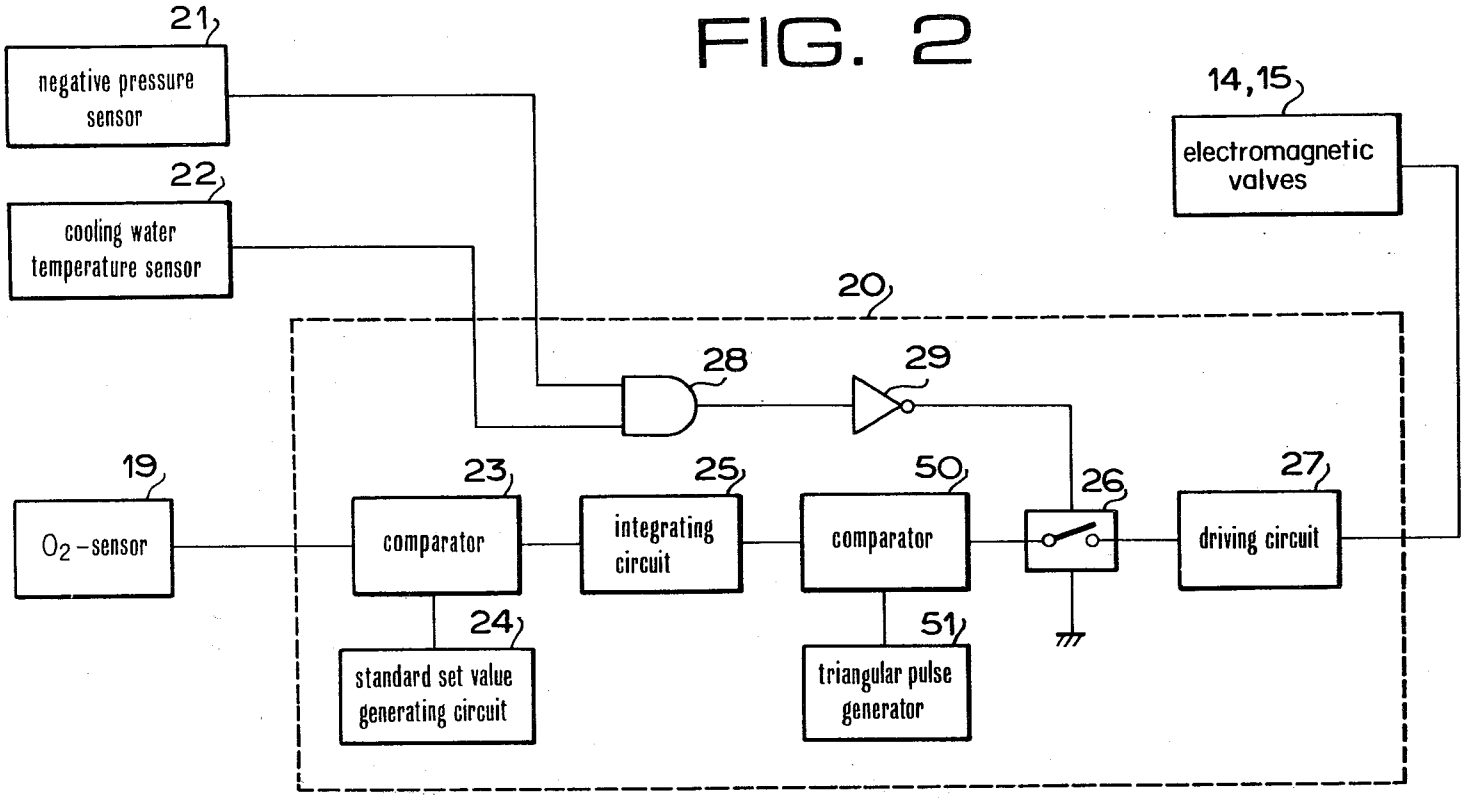
FIG. 2 is a block diagram of a control circuit used in the system.

FIG. 2 shows a constitution of the control circuit 20, where the output of the $O_2$-sensor 19 is sent to a comparator 23 to be compared with a standard set value from a standard set value generating circuit 24. The output of the comparator 23 is transmitted to an integrating circuit 25, the integrated output of which is applied to a comparator 50. The comparator 50 is applied with a triangular pulse train from a triangular pulse generator 51. The output of the comparator 50 is connected to a driving circuit 27 for the electro-magnetic valves 14, 15 via a switch circuit 26. Outputs of the negative pressure sensor 21 and the cooling water temperature sensor 22 are sent to an AND gate 28, the output of which is in turn sent to an inverter 29 to open or close the switch circuit 26.

Figure 3:
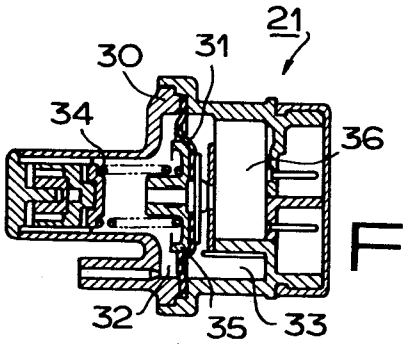
FIG. 3 is a cross-sectional view of a negative pressure sensor.
Figure 5:
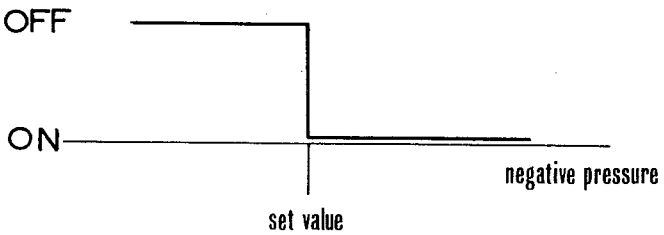
FIG. 5 illustrates a characteristic curve of the negative pressure sensor.

In FIG. 3 showing the negative pressure sensor 21, a hollow cylindrical body 30 is sealingly divided by a diaphragm 31 into a pressure chamber 32 communicating with the intake passage of the carburetor 1 and a switch chamber 33 communicating with the atmosphere. A coil spring 34 is inserted in the pressure chamber 32 to bias the diaphragm 31 by means of an operating member 35. In the switch chamber 33, a micro-switch 36 is provided which is actuated by the diaphragm 31. FIG. 5 shows the characteristics of the output of the negative pressure sensor 21, indicating than when the negative pressure is low (when the acceleration pedal is depressed), the difference between the pressures in the pressure chamber 32 and the switch chamber 33 is small so that the diaphragm 31 is deflected by the coil spring 34 to turn on the micro-switch 36, and that when the negative pressure is high (when the acceleration pedal is released), because of a large pressure difference, the diaphragm 31 compresses the coil spring 34, turning off the micro-switch 36.

Figure 4:
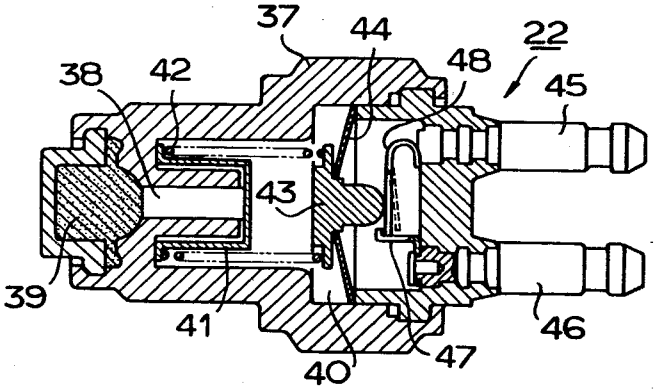
FIG. 4 is a cross-sectional view of a temperature sensor.

FIG. 4 shows the cooling water temperature sensor 22. A hollow cylindrical body 37 is sealingly divided by a plunger 38 into a wax chamber 39 filled with wax and a spring chamber 40. A spring receiver 41 engaging with the plunger 38 is inserted into the spring chamber 40. The coil spring 42 is provided between the spring receiver 41 and an operating member 43 which is supported by a spring 44. Fixed at the end of the cylindrical body 37 are a pair of terminals 45 and 46. A resilient movable contact 48 is secured on the terminal 45, and a fixed contact 47 is secured to the terminal 46. The contact 48 also engages with the operating member 43.

Figure 6:
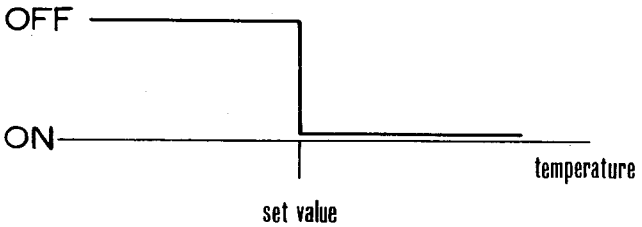
FIG. 6 illustrates a characteristic curve of the temperature sensor.

FIG. 6 shows the characteristics of the output of the temperature sensor 22, indicating that when the temperature of the cooling water is low, wax is condensed so that the plunger 38 and the operating member 43 are moved to the left by the spring 44 to thereby engage the contact 48 with the contact 47 which means closing of the switch. When the temperature is high, wax in the wax chamber 39 is expanded and pushes the plunger 38 and spring receiver 41 to the right so that the operating member 43 is forced by the coil spring 42 against the spring 44 to push the contact 48. Thus, the switch is opened.

The operation of the present invention will be explained hereinafter. When the temperature of the engine cooling water is higher than a preset value, the temperature sensor 22 remains off and sends the corresponding low-level output signal to the AND gate 28. Therefore, the output of the AND gate 28 is kept at a low level regardless of the level of the input from the negative pressure sensor 21. This low level output of the AND gate 28 is inverted to a high level by the inverter 29, so that the switch circuit 26 is closed. Consequently, the comparator 50 is connected to the driving circuit 27, that means that the closed loop air-fuel ratio control circuit is established. In other words, the signal representing oxygen concentration in exhaust gases detected by the $O_2$-sensor 19 is compared with the standard set value by the comparator 23 and determined as to whether the ratio of the air-fuel mixture supplied to the engine is lean or rich. The output of the comparator 23 is integrated by the integrating circuit 25 to send the correction signal to the comparator 50 where the correction signal is compared with triangular wave pulses from the triangular wave pulse generator 51 and is converted to square wave pulses. The square wave pulses have a duty ratio corresponding to the output of the integrating circuit 25. The square wave pulses are sent to the electro-magnetic valves 14, 15 through the driving circuit 27 to open and close the valves for feeding the correcting air to the carburetor. Thus, the air-fuel ratio of the mixture supplied by the carburetor 1 is controlled to the stoichiometric air-fuel ratio.

When the temperature of the engine cooling water 6 is lower than the preset value, the temperature sensor 22 is on, as above described in relation with FIG. 6, and sends a high level signal to the AND gate 28. Accordingly, the output of the AND gate 28 is changed in dependency on the level of the input from the negative pressure sensor 21. If the output of the negative pressure sensor 21 is at a low level signal, the AND gate 28 produces a low level output which causes the switch circuit 26 to close. Thus, the correction of the air is carried out by the closed loop control. However, when the acceleration pedal is depressed for acceleration, the negative pressure in the intake passage of the carburetor 1 is reduced so that the coil spring 34 urges the operating member 35 to the micro-switch 36 to turn on it. Thus, as the AND gate 28 is applied with the high level input, a high level output of the AND gate 28 and hence a low level output of the inverter 29 causes the switch circuit 26 to open. Consequently, the correction signal from the integrating circuit 25 is not applied to the driving circuit 27, and accordingly the electro-magnetic valves 14 and 15 do not operate and therefore remain closed. Because the air for correction is not supplied to the carburetor, the air-fuel ratio of the mixture fed from the carburetor 1 to the engine 2 becomes richer.

As a result, the engine is driven with a rich air-fuel mixture having a predetermined air-fuel ratio set by the carburetor, which is responsive to the operating conditions such as the acceleration and the increase of load of the engine. Consequently, a stable driveability according to the operation of acceleration is expected without temporary dropping of engine power.

As above described, in accordance with the present invention, in the cold engine operating condition and accelerating condition, the control of the air-fuel ratio correction is stopped to thereby supply a rich air-fuel mixture. Therefore, temporary dropping of engine power and stumble operation can be prevented. Thus, the driveability of the engine may be improved.

What is claimed is:

1. In an air-fuel ratio control system for an internal combustion engine having a carburetor including an intake passage, an electromagnetic valve for correcting the air-fuel ratio of the air-fuel mixture supplied to said carburetor, an $O_2$ sensor for detecting oxygen concentration of exhaust gases from the engine, a temperature sensor for detecting the engine temperature, an acceleration detecting sensor for being operated corresponding to negative pressure in said intake passage of the engine, and a closed loop control circuit responsive to outputs of all of the sensors for producing a control output signal for driving said electromagnetic valve for correcting the air-fuel ratio, the improvement comprising a switching circuit means provided in said control circuit for rendering said control circuit non-responsive to the output of said $O_2$ sensor, gate means responsive to outputs of said temperature sensor and said acceleration detecting sensor for actuating said switching circuit comprising an AND gate connected to said temperature sensor and said acceleration detecting sensor, and said gate means being so arranged to actuate said switching circuit means in such a manner that air-fuel ratio correction control with the closed loop control circuit is carried out when engine temperature is higher than a predetermined temperature and stopped when engine temperature is lower than said predetermined temperature and said acceleration detecting sensor is operated.

2. The air-fuel ratio control system for an internal combustion engine in accordance with claim 1 wherein said acceleration detecting sensor is a negative pressure sensor detecting negative pressure in said intake passage.

3. The air-fuel ratio control system for an internal combustion engine in accordance with claim 1 wherein said electromagnetic valve is an on-off type electromagnetic valve for correcting the amount of air induced into said carburetor.

* * * * *